US011253130B2

(12) United States Patent
Zhu et al.

(10) Patent No.: US 11,253,130 B2
(45) Date of Patent: Feb. 22, 2022

(54) CLEANING TOOL CAPABLE OF EXPANDING DURING USE AND CONTRACTING WHEN TO BE CLEANED

(71) Applicant: JIAXING JACKSON TRAVEL PRODUCTS CO., LTD, Jiaxing (CN)

(72) Inventors: Xue Lin Zhu, Jiaxing (CN); Ju Hong Zhang, Jiaxing (CN)

(73) Assignee: JIAXING JACKSON TRAVEL PRODUCTS CO., LTD, Jiaxing (CN)

( * ) Notice: Subject to any disclaimer, the term of this patent is extended or adjusted under 35 U.S.C. 154(b) by 239 days.

(21) Appl. No.: 16/603,236

(22) PCT Filed: Apr. 9, 2018

(86) PCT No.: PCT/CN2018/082359
§ 371 (c)(1),
(2) Date: Oct. 7, 2019

(87) PCT Pub. No.: WO2018/192381
PCT Pub. Date: Oct. 25, 2018

(65) Prior Publication Data

US 2020/0275819 A1 Sep. 3, 2020

(30) Foreign Application Priority Data

Apr. 17, 2017 (CN) ..... 201720400162.3

(51) Int. Cl.
*A47L 13/258* (2006.01)

(52) U.S. Cl.
CPC ..... *A47L 13/258* (2013.01)

(58) Field of Classification Search
CPC ..... A47L 13/24; A47L 13/254; A47L 13/256; A47L 13/258; A47L 11/22; A47L 11/26; A47L 11/04; A47L 11/06; A47L 11/08
(Continued)

(56) References Cited

U.S. PATENT DOCUMENTS

2005/0044648 A1* 3/2005 Jones ..... A47L 13/24 15/172
2012/0167321 A1* 7/2012 Lee ..... A47L 13/59 15/119.2

FOREIGN PATENT DOCUMENTS

CN 201806660 U * 4/2011
CN 103417168 A 12/2013
(Continued)

OTHER PUBLICATIONS

Translation of CN204889887U, retrieved from Espaceneton Jul. 26, 2021 (Year: 2015).*
(Continued)

*Primary Examiner* — Laura C Guidotti
*Assistant Examiner* — Thomas Raymond Rodgers
(74) *Attorney, Agent, or Firm* — Bayramoglu Law Offices LLC

(57) ABSTRACT

A cleaning tool capable of contracting to be cleaned and expanding to be used includes a mop and a cleaning barrel. The mop includes a mop head and a mop rod connected with the mop head. The mop rod is a rotary mop rod which is able to linearly move upwards or downward and be driven to rotate. A support site used for supporting the mop rod during rotation is arranged in the cleaning barrel. The mop further includes a transformation driving mechanism. The mop head includes movable plates and a base plate. The movable plates are located on the same plane as the base plate and are able to rotate relative to the base plate. A track mechanism is arranged between the movable plates and the base plate. The mop rod is able to rotate relative to the base plate to drive the transformation driving mechanism.

10 Claims, 4 Drawing Sheets

(58) Field of Classification Search
USPC ..... 15/143.1, 228
See application file for complete search history.

(56) References Cited

FOREIGN PATENT DOCUMENTS

| | | | |
|---|---|---|---|
| CN | 203749349 | U | 8/2014 |
| CN | 204889887 | U | 12/2015 |
| CN | 206026261 | U | 3/2017 |
| JP | H1147059 | A | 2/1999 |
| KR | 100817766 | B1 | 3/2008 |
| KR | 20150053411 | A | 5/2015 |

OTHER PUBLICATIONS

Translation of CN201806660U, retrieved from Espaceneton Jul. 26, 2021 (Year: 2011).*

* cited by examiner

CLEANING TOOL CAPABLE OF EXPANDING DURING USE AND CONTRACTING WHEN TO BE CLEANED

CROSS REFERENCE TO RELATED APPLICATIONS

This application is the national phase entry of the International Application No. PCT/CN2018/082359, filed on Apr. 9, 2018, which is based upon and claimed priority to Chinese Patent Application No. 201720400162.3, filed on Apr. 17, 2017 the entire contents of which are incorporated herein by reference.

TECHNICAL FIELD

The invention relates to a cleaning tool capable of contracting to be cleaned and expanding to be used, and belongs to the technical field of cleaning tools.

BACKGROUND

Chinese Invention Patent Publication No. CN 103417168 A discloses a rotary mop capable of being spun and wrung dry. The rotary mop capable of being spun and wrung dry includes a rotary mop rod mechanism and a mop head mechanism, wherein the rotary mop rod mechanism includes an outer tube, an inner tube, and a rotation driving mechanism, and the outer tube and the inner tube are movably connected through the rotation driving mechanism, can move vertically relative to each other in the axial direction, and can also rotate relative to each other; and the mop head mechanism is fixedly connected with the inner tube. The rotary mop capable of being spun and wrung dry further includes a drying mechanism which is disposed around the inner tube and is able to move vertically along the inner tube. The area of a mop head of this mop cannot be changed, so that the mopping area of the mop head has a direct relation with a cleaning barrel. The mopping area of existing mop heads is too small, which results in low mopping efficiency. While, in order to enlarge the mopping area of the mop heads, the cleaning barrel has to be made larger accordingly, which will in turn lead to a large size and a sharp increase of the manufacturing cost and the logistics cost.

SUMMARY

The objective of the invention is to overcome the defects of the prior art by providing a cleaning tool which is capable of contracting to be cleaned and expanding to be used, reasonable in structural design, easy to operate, and variable in length and width.

According to the technical solution adopted by the invention to fulfill the above objective, the cleaning tool capable of contracting to be cleaned and expanding to be used includes a mop and a cleaning barrel, wherein the mop includes a mop head and a mop rod connected with the mop head, the mop rod is a rotary mop rod which is able to linearly move upwards or downwards and be driven to rotate, and a support site used for supporting the mop head during rotation is arranged in the cleaning barrel; the mop further includes a transformation driving mechanism; the mop head includes movable plates and a base plate, the movable plates are located on the same plane as the base plate and are able to slide relative to the base plate, and a track mechanism used for defining a movement track of the movable plates is arranged between the movable plates and the base plate; the mop rod is able to rotate relative to the base plate to drive the transformation driving mechanism to drive the movable plates to move so as to change the length and width of the mop head.

Furthermore, a junction of the mop rod and the mop head is always located at the center of the mop head before and after the length and width of the mop head are changed.

Furthermore, the transformation driving mechanism includes a driving gear connected with the mop rod and driven gears connected with the movable plates, and the driving gear rotates to drive the movable plates to rotate through the driven gears; and the track mechanism is composed of sliding grooves formed in the base plate and sliding blocks arranged on the movable plates, and the sliding blocks are inserted into the sliding grooves and move in the sliding grooves; or, the positions of the sliding grooves and the positions of the sliding blocks are exchanged.

Furthermore, the base plate is arranged between the movable plates and the driven gears, and the driven gears are fixedly connected with the sliding blocks.

Furthermore, the cleaning tool further includes an upper cover, an external universal joint assembly and an internal universal joint assembly, wherein the upper cover is arranged over the base plate, and the internal universal joint assembly is arranged in the external joint assembly; the external universal joint assembly includes an external upper joint and an external lower joint, the external upper joint is rotatably connected with the external lower joint, and the external lower joint is rotatably connected with the upper cover; and the internal universal joint assembly includes an internal upper joint and an internal lower joint, the internal upper joint is rotatably connected with the internal lower joint, the internal lower joint is rotatably connected with a driving wheel, and the internal upper joint is connected with the mop rod.

Furthermore, the transformation driving mechanism includes a stretchable connecting rod, wherein two ends of the stretchable connecting rod are rotatably mounted on the movable plates respectively, the mop rod is connected with the stretchable connecting rod and is able to rotate to drive the stretchable connecting rod to rotate, and when rotating in place, the stretchable connecting rod is able to stretch or retreat.

Furthermore, the stretchable connecting rod includes at least two telescopic rods, a jacket, a tension spring and a cam, wherein the telescopic rods are arranged in the jacket, two ends of the tension spring are connected with the two telescopic rods, and the cam is arranged between the two telescopic rods and is able to rotate relative to the jacket to drive the telescopic rods to stretch or retreat.

Furthermore, the cleaning barrel includes a barrel body and a support, wherein the support is arranged in the barrel body and is able to rotate relative to the barrel body.

Furthermore, the support is provided with a clamping body, the base plate is provided with a clamping jaw, and during drying, the clamping jaw corresponds to the clamping body.

Compared with the prior art, the invention has the following advantages and effects:

When the cleaning tool is used for mopping a floor, the mopping area of the mop can be maximized (the length is increased) to improve the mopping efficiency; and when the mop is placed in the cleaning barrel to be cleaned, the size of the mop head can be decreased, and the distance from the center (the junction of the mop rod and the mop head) to the edge of the mop head is decreased to facilitate centrifugal drying or cleaning.

DETAILED DESCRIPTION OF THE INVENTION

The invention is further expounded below with reference to the accompanying drawings and embodiments. The following embodiments are only used to explain the invention, and are not intended to limit the invention.

Embodiment 1

Figure 1:
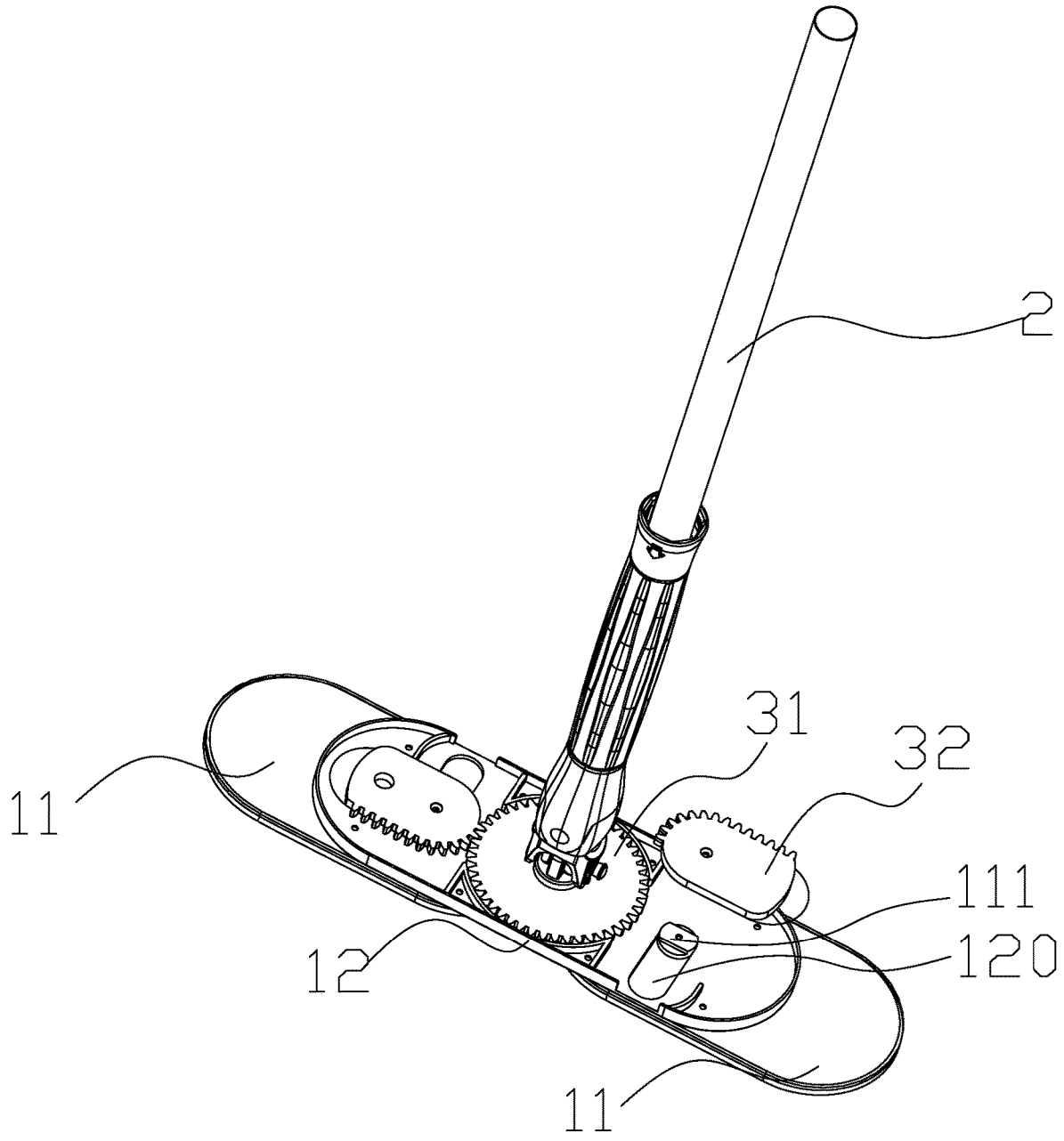
FIG. 1 shows a structural diagram of Embodiment 1 of the invention.
Figure 2:
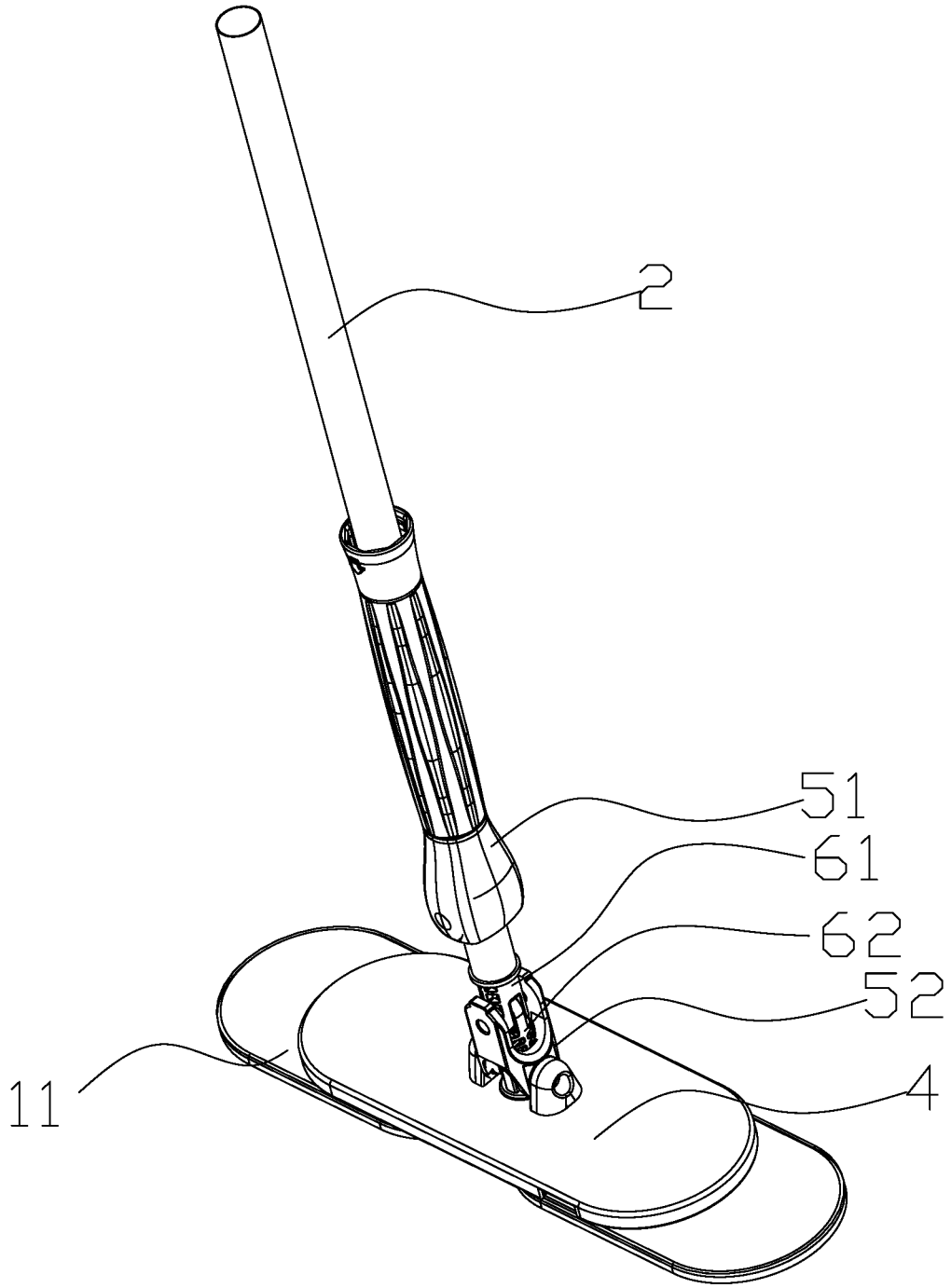
FIG. 2 shows a structural diagram of Embodiment 1 of the invention after an upper cover is assembled.
Figure 3:
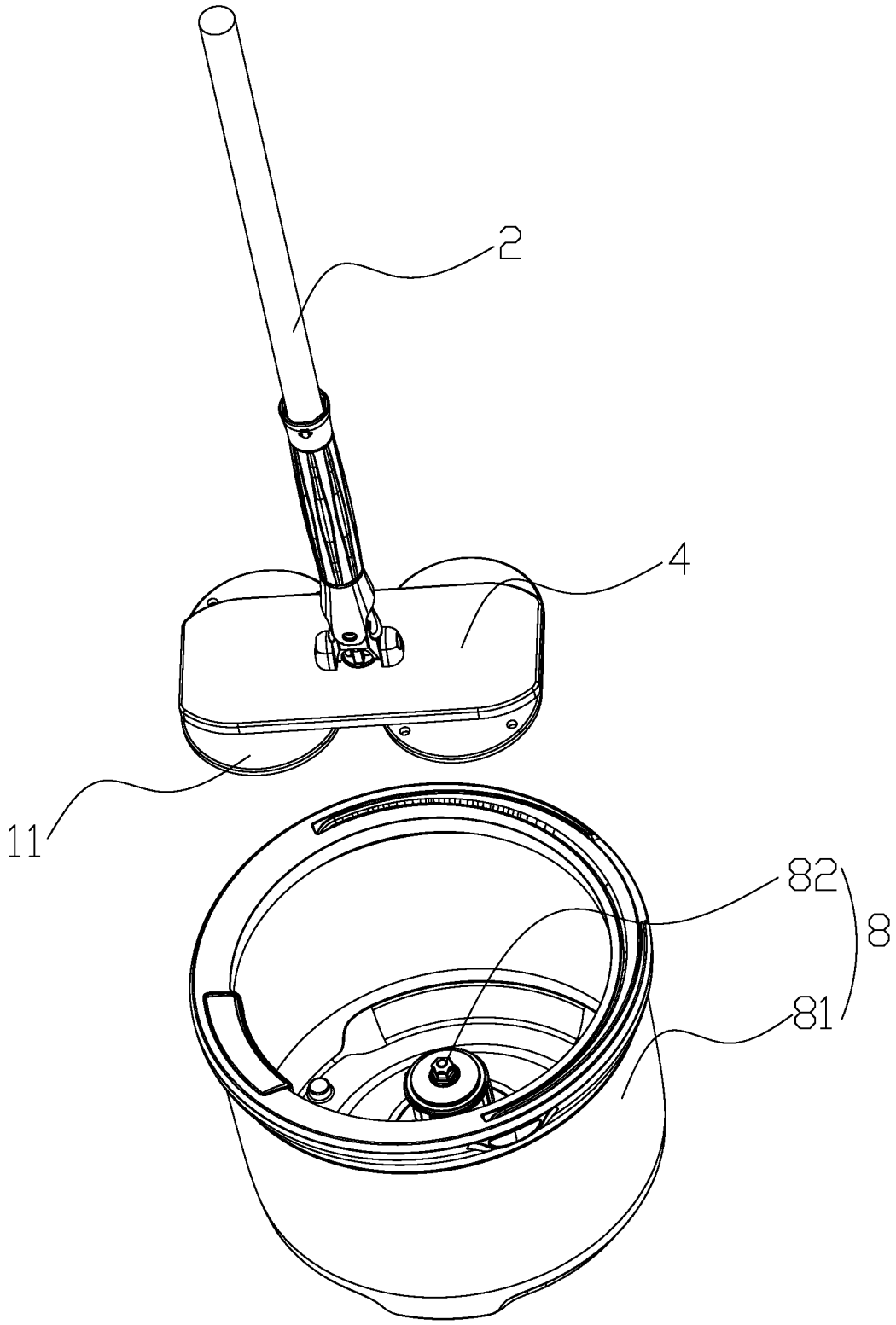
FIG. 3 shows a structural diagram of the invention in a cleaned state.

As shown in FIG. 1-FIG. 3, a cleaning tool capable of contracting to be cleaned and expanding to be used in this embodiment includes a mop and a cleaning barrel. The mop includes a mop head and a mop rod 2 connected with the mop head, and the mop rod 2 is a rotary mop rod which is able to linearly move upwards or downwards and be driven to rotate. A support site used for supporting the mop head during rotation is arranged in the cleaning barrel. The cleaning tool further includes a transformation driving mechanism. The mop head includes two movable plates 11 and a base plate 12, wherein the movable plates 11 are located on the same plane as the base plate 12 and are able to slide relative to the base plate 12, and a track mechanism used for defining a movement track of the movable plates 11 is arranged between the movable plates 11 and the base plate 12. The mop rod 2 is able to rotate relative to the base plate 12 to drive the transformation driving mechanism to drive the movable plates 11 to move along the track mechanism so as to change the length and width of the mop head.

In this embodiment, the junction of the mop rod 2 and the mop head is always located at the center of the mop head before and after the length and width of the mop head are changed. During centrifugal drying, it is necessary to make sure that the junction of the mop rod 2 and the mop head is located at the center of the mop head.

In this embodiment, the transformation driving mechanism includes a driving gear 31 connected with the mop rod 2 and driven gears 32 connected with the movable plates 11, wherein the driving gear 31 rotates to drive the movable plates 11 to rotate through the driven gears 32. The track mechanism is composed of sliding grooves 120 formed in the base plate 12 and sliding blocks 111 arranged on the movable plate 11, wherein the sliding grooves 120 are diagonally formed in two sides of the base plate 12 in a mirror symmetry manner, and the sliding blocks 111 are inserted into the sliding grooves 120 and move along the sliding grooves 120. Or, the positions of the sliding grooves 120 and the positions of the sliding blocks 111 are exchanged; that is to say, the sliding grooves 120 are formed in the movable plates 11, the sliding blocks 111 are arranged on the base plate 12, and the sliding blocks 111 are inserted into the sliding grooves 120 and move along the sliding grooves 120.

When driven by the mop rod 2, the driving gear 31 drives the movable plates 11 to rotate by 90° through the driven gears 32, so that the length, which is originally equal to the sum of the lengths of at least two movable plates 11, of the mop head is changed into the sum of the widths of at least two movable plates 11, the width, which is originally equal to the width of at least one movable plate 11, of the mop head is changed into the length of at least one movable plate 11, namely, with the junction of the mop rod 2 and the mop head as a center, the distance from the center to the edge of the mop head is decreased.

In this embodiment, the base plate 12 is arranged between the movable plates 11 and the driven gears 32, and the driven gears 32 are fixedly connected with the sliding blocks 111. The driven gears 32 rotate in the circumferential direction to drive the movable plates 11 and position the movable plates 11 in the vertical direction.

In this embodiment, the cleaning tool further includes an upper cover 4, an external universal joint assembly, and an internal universal joint assembly, wherein the upper cover 4 is arranged over the base plate 12, and the internal universal joint assembly is arranged in the external universal joint assembly; the external universal joint assembly includes an external upper joint 51 and an external lower joint 52, the external upper joint 51 is rotatably connected with the external lower joint 52, and the external lower joint 52 is rotatably connected with the upper cover 4; and the internal universal joint assembly includes an internal upper joint 61 and an internal lower joint 62, the internal upper joint 61 is rotatably connected with the internal lower joint 62, the internal lower joint 62 is rotatably connected with a driving wheel, and the internal upper joint 61 is connected with the mop rod 2. The mop rod can rotate in all directions through the external universal joint assembly and the internal universal joint assembly, and cleaning and mopping can be performed more conveniently and rapidly.

In this embodiment, the cleaning barrel 8 includes a barrel body 81 and a support 82, wherein the support 82 is arranged in the barrel body 81 and is able to rotate relative to the barrel body 81.

In this embodiment, the support 82 is provided with a clamping body, and the base plate 12 is provided with a clamping jaw **4*a*. During drying, the clamping jaw 4*a* corresponds to the clamping body. When the mop is used for mopping a floor, the distance from the center (the junction of the mop rod 2 and the mop head) to the edge of the mop head is maximized, and in this case, the mopping area of the mop is maximized accordingly. When the mop is placed in the cleaning barrel to be wrung dry, the distance from the center (the junction of the mop rod 2** and the mop head) to the edge of the mop head is decreased, and the cleaning barrel can be made smaller accordingly.

Embodiment 2

Figure 4:
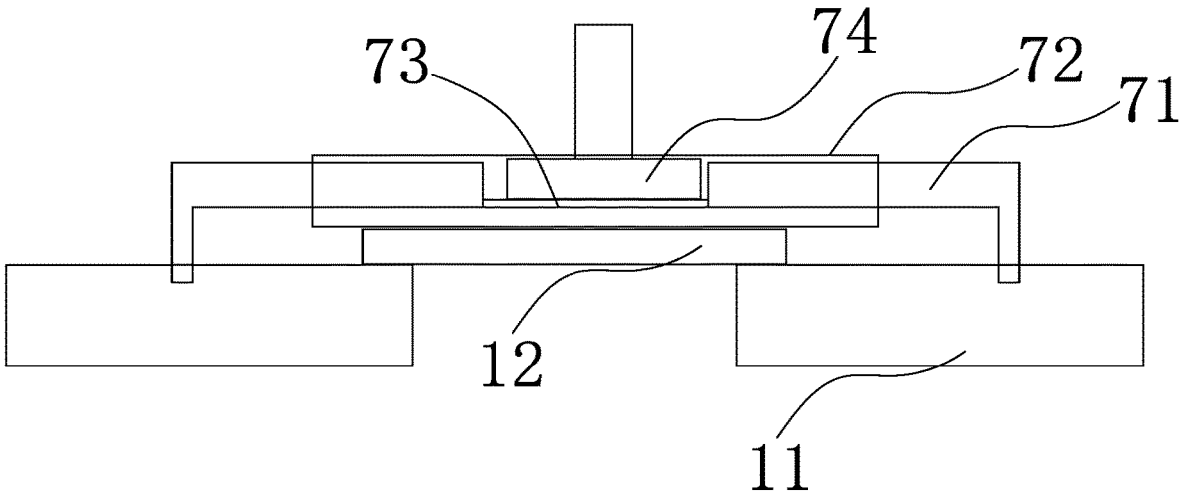
FIG. 4 shows a structural diagram of Embodiment 2 of the invention.
Figure 5:
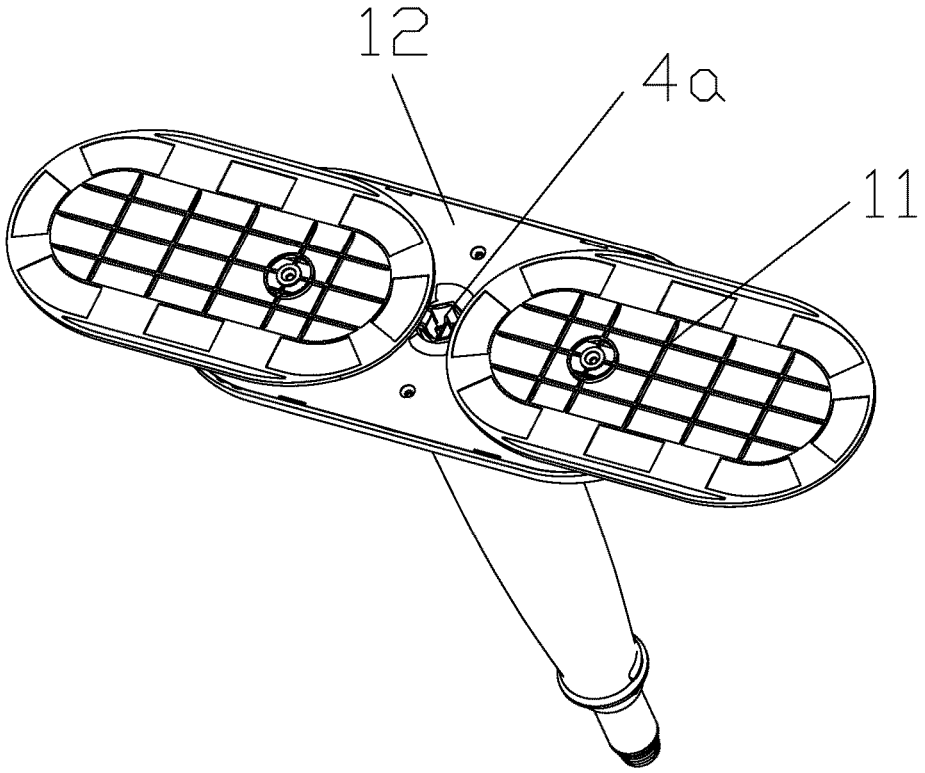
FIG. 5 shows a bottom-up perspective diagram of the cleaning tool shown in FIG. 1.

As shown in FIG. 4, in this embodiment, the transformation driving mechanism is implemented in another way. Particularly, the transformation driving mechanism includes a stretchable connecting rod 7, wherein two ends of the stretchable connecting rod 7 are rotatably mounted on the movable plates 11 respectively, the mop rod 2 is connected with the stretchable connecting rod 7 and drives the stretchable connecting rod 7 to rotate, and after rotating in place, the stretchable connecting rod 7 is able to stretch or retreat.

In this embodiment, the stretchable connecting rod 7 includes at least two telescopic rods 71, a jacket 72, a tension spring 73, and a cam 74, wherein the telescopic rods 71 are arranged in the jacket 72, two ends of the tension spring 73 are connected with the two telescopic rods 71, the cam 74 is arranged between the two telescopic rods 71, and the cam 74 is able to rotate relative to the jacket 72 to drive the telescopic rods 71 to stretch or retreat. The distance between the two movable plates 11 can be adjusted through telescopic sliding of the telescopic rods 71.

The above contents in the specification are only used for illustratively explaining the invention. Various modifications, supplements, or similar substitutes of the specific embodiments mentioned above can be obtained by those skilled in the art without deviating from the contents of the specification or going beyond the scope defined by the claims, and all these modifications, supplements, or similar substitutes should also fall within the protection scope of the invention.

What is claimed is:

1. A cleaning tool capable of contracting to be cleaned and expanding to be used, comprising: a mop and a cleaning barrel, wherein, the mop comprises a mop head and a mop rod connected with the mop head, the mop rod is a rotary mop rod, wherein, the rotary mop rod is configured to linearly move upwards or downwards and be driven to rotate, and a support site used for supporting the mop head during a rotation is arranged in the cleaning barrel when the mop head is not expanded; the mop further comprises a transformation driving mechanism; the mop head comprises at least one movable plate and a base plate, the at least one movable plate is located on a same plane as the base plate and are configured to rotate relative to the base plate, and a track mechanism used for defining a movement track of the at least one movable plate is arranged between the at least one movable plate and the base plate; and the mop rod is configured to rotate relative to the base plate to drive the transformation driving mechanism to drive the at least one movable plate to move so as to change a length and a width of the mop head, wherein the transformation driving mechanism comprises a driving gear directly contacting the mop rod, a first driven gear and a second driven gear, wherein the first and second driven gears are each fixedly connected with a plurality of sliding blocks arranged on the at least one movable plate, and the driving gear rotates to drive the at least one movable plate to rotate through the first driven gear and the second driven gear and the track mechanism is composed of a plurality of sliding grooves formed in the base plate and the plurality of sliding blocks arranged on the at least one movable plate, and the plurality of sliding blocks are inserted into the plurality of sliding grooves and move in the plurality of sliding grooves.

2. The cleaning tool capable of contracting to be cleaned and expanding to be used according to claim 1, wherein a junction of the mop rod and the mop head is always located at a center of the mop head before and after the length and width of the mop head are changed.

3. The cleaning tool capable of contracting to be cleaned and expanding to be used according to claim 2, further comprising the upper cover, the external universal joint assembly and the internal universal joint assembly, wherein the upper cover is arranged over the base plate, and the internal universal joint assembly is arranged in the external joint assembly; the external universal joint assembly comprises an external upper joint and an external lower joint, the external upper joint is rotatably connected with the external lower joint, and the external lower joint is rotatably connected with the upper cover; and the internal universal joint assembly comprises an internal upper joint and an internal lower joint, the internal upper joint is rotatably connected with the internal lower joint, the internal lower joint is rotatably connected with the driving gear, and the internal upper joint is connected with the mop rod.

4. The cleaning tool capable of contracting to be cleaned and expanding to be used according to claim 1, wherein, the base plate is arranged between the at least one movable plate and the plurality of driven gears.

5. The cleaning tool capable of contracting to be cleaned and expanding to be used according to claim 4, further comprising the upper cover, the external universal joint assembly and the internal universal joint assembly, wherein the upper cover is arranged over the base plate, and the internal universal joint assembly is arranged in the external joint assembly; the external universal joint assembly comprises an external upper joint and an external lower joint, the external upper joint is rotatably connected with the external lower joint, and the external lower joint is rotatably connected with the upper cover; and the internal universal joint assembly comprises an internal upper joint and an internal lower joint, the internal upper joint is rotatably connected with the internal lower joint, the internal lower joint is rotatably connected with the driving gear, and the internal upper joint is connected with the mop rod.

6. The cleaning tool capable of contracting to be cleaned and expanding to be used according to claim 1, further comprising an upper cover, an external universal joint assembly and an internal universal joint assembly, wherein the upper cover is arranged over the base plate, and the internal universal joint assembly is arranged in the external joint assembly; the external universal joint assembly comprises an external upper joint and an external lower joint, the external upper joint is rotatably connected with the external lower joint, and the external lower joint is rotatably connected with the upper cover; and the internal universal joint assembly comprises an internal upper joint and an internal lower joint, the internal upper joint is rotatably connected with the internal lower joint, the internal lower joint is rotatably connected with the driving gear, and the internal upper joint is connected with the mop rod.

7. The cleaning tool capable of contracting to be cleaned and expanding to be used according to claim 1, wherein the transformation driving mechanism comprises a stretchable connecting rod, two ends of the stretchable connecting rod are rotatably mounted on the at least one movable plate respectively, the mop rod is connected with the stretchable connecting rod and is configured to rotate to drive the stretchable connecting rod to rotate, and when rotating in place, the stretchable connecting rod is able to stretch or retreat.

8. The cleaning tool capable of contracting to be cleaned and expanding to be used according to claim 7, wherein the stretchable connecting rod comprises at least two telescopic rods, a jacket, and a cam; wherein, the telescopic rods are arranged in the jacket, and the cam is arranged between the two telescopic rods and is configured to rotate relative to the jacket to drive the telescopic rods to stretch or retreat.

9. The cleaning tool capable of contracting to be cleaned and expanding to be used according to claim 1, wherein the cleaning barrel comprises a barrel body and the support site, and the support site is arranged in the barrel body and is configured to rotate relative to the barrel body.

10. The cleaning tool capable of contracting to be cleaned and expanding to be used according to claim 9, wherein the support site is provided with a clamping body, the base plate is provided with a clamping jaw, and during drying, the clamping jaw corresponds to the clamping body.

* * * * *